United States Patent [19]

Pavlyak

[11] Patent Number: 4,724,596

[45] Date of Patent: Feb. 16, 1988

[54] METHOD OF MAKING INTERLOCKED METAL TUBE

[75] Inventor: Gyula Pavlyak, Enfield, Great Britain

[73] Assignee: T.I. Flexible Tubes Limited, Enfield, Great Britain

[21] Appl. No.: 854,133

[22] Filed: Apr. 21, 1986

[30] Foreign Application Priority Data

Apr. 20, 1985 [GB] United Kingdom ..... 8510157

[51] Int. Cl.[4] ..... B21D 39/03; B23P 11/00

[52] U.S. Cl. ..... 29/429; 29/453; 29/509; 29/456; 72/49; 72/368; 138/135

[58] Field of Search ..... 29/429, 505, 453, 456; 72/49, 50; 138/135

[56] References Cited

U.S. PATENT DOCUMENTS

| | | | |
|---|---|---|---|
| 1,596,215 | 8/1926 | Palmer | 72/49 X |
| 1,617,583 | 2/1927 | Fentress et al. | 72/49 |
| 2,862,469 | 12/1958 | Jensen | 72/49 |
| 3,204,666 | 9/1965 | Lindsay et al. | 138/135 |
| 3,331,400 | 7/1967 | Vilkaitis | 138/135 |
| 3,682,203 | 8/1972 | Foti et al. | 138/135 |
| 4,081,981 | 4/1978 | Lipp | 72/49 |
| 4,197,728 | 4/1980 | McGowen | 72/49 |
| 4,597,276 | 7/1986 | Legallais et al. | 72/49 |
| 4,598,739 | 7/1986 | Burcher | 138/135 |
| 4,630,650 | 12/1986 | Davis | 138/135 X |

*Primary Examiner*—Charlie T. Moon

*Attorney, Agent, or Firm*—Gifford, Groh, VanOphem, Sheridan, Sprinkle and Dolgorukov

[57] ABSTRACT

A method of making interlocked metal tube from a strip of the metal of generally S-shaped cross-section by which the shaped strip is formed into a helix without interengaging adjacent coils of the helix, passing the helix without rotation through a rotating driving means to move the non-rotating helix axially, interengaging adjacent coils of the helix and then performing an operation to prevent subsequent disengagement of the adjacent coils, thereby to form an interlocked metal tube. The driving means for the helix is a rotatably-driven mandrel around which the open helix is placed. The mandrel has intermediate its ends a radially-outwardly extending integral portion in which there is a helical passageway forming a tunnel through which the helix is passed and from which the helix is delivered to move without rotation axially along the remainder of the mandrel.

11 Claims, 6 Drawing Figures

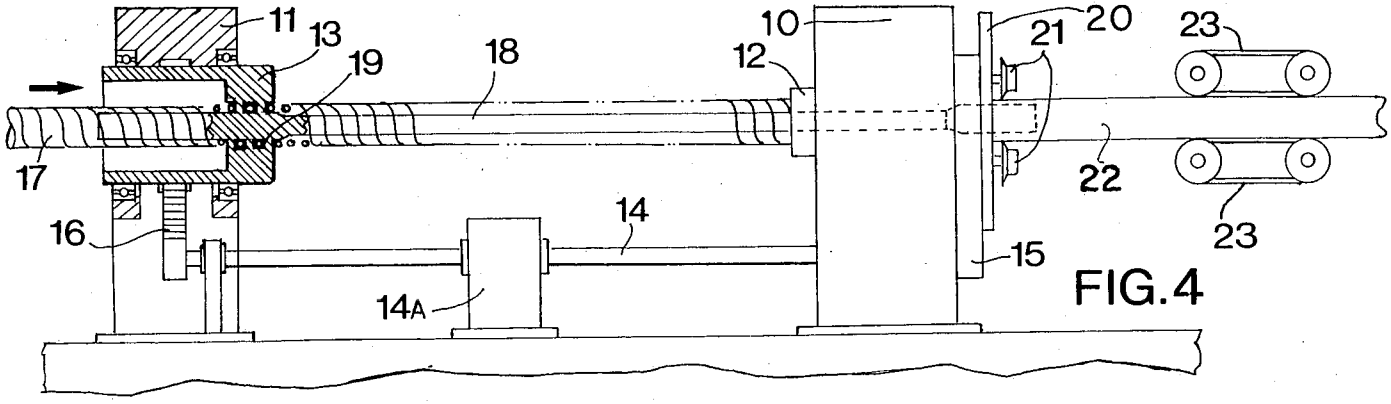
FIG.4
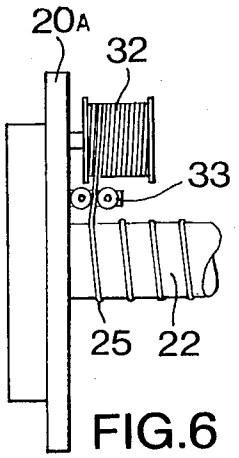
FIG.6
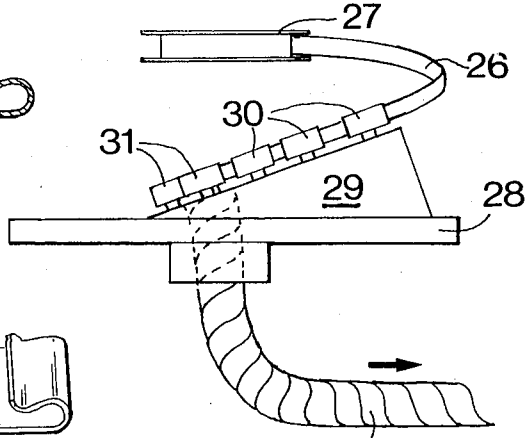
FIG.5
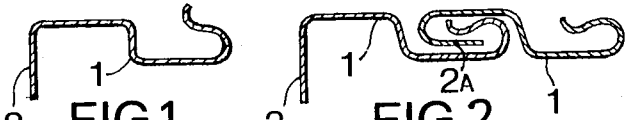
FIG.1
FIG.2
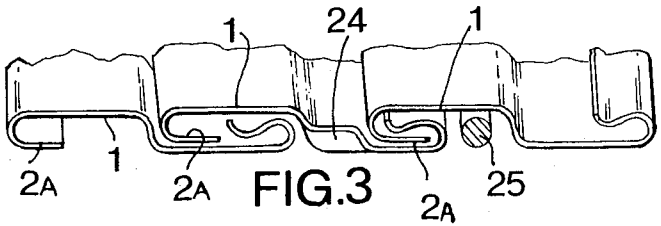
FIG.3

METHOD OF MAKING INTERLOCKED METAL TUBE

BACKGROUND OF THE INVENTION AND DESCRIPTION OF THE PRIOR ART

The invention relates to a method of for making interlocked metal tube. Such tube is currently made from a long strip of a suitable metal, such as steel or stainless steel, by passing the flat strip through a succession of pairs of forming rolls which gradually form the strip into a generally S-shaped cross-section of which one or both of the ends of the "S" are open. The formed strip is bent around a mandrel into a helical formation, at the same time the downwardly-facing opened end of the "S" of the strip is forced into the bight formed by the upwardly-facing opened end of the "S" of the previously wound coil on the mandrel, the opened ends being closed sufficiently to prevent adjacent coils of the helix from becoming disengaged. The finished section of the "S" provides limited axial movement between the adjacent coils to enable the tube to be partially extended axially or to be bent into a curve.

In the process described above, the tube thus formed moves axially along the mandrel and the whole length of the formed tube rotates. Thus, there is a practical limit to the length of finished tube which can be formed by that process. Firstly, problems arise in maintaining a long length in continuous rotation. Secondly, it is very difficult after the S-shaped strip has been formed and engaged and closed with the adjacent coil to weld end-to-end lengths of such tube which are short enough to manufacture, and then to dress the weld.

SUMMARY OF THE INVENTION

According to one aspect of the present invention, a method of making interlocked metal tube includes the steps of forming a flat strip of the metal into a generally S-shaped cross-section; forming the shaped strip into a helix without interengaging adjacent coils of the helix; passing the helix thus formed without rotation thereof through a rotatable driving means for moving the non-rotating helix axially of the helix; interengaging adjacent coils of the helix, and performing an operation to prevent subsequent disengagement of the adjacent coils, thereby forming an interlocked metal tube.

The helix may rotate as it is formed, a length of the helix being stopped from rotating and fed to the said rotatable driving means.

The method may include interengaging adjacent coils of the helix and deforming the interengaging coils in a manner which will prevent subsequent disengagement thereof. The deformation of the interengaging coils may be effected by bending one or both ends of the cross section of the coil during the interengaging process or by forming the strip into a cross section such that the coils can be interengaged subsequently without deformation of the coil cross-section.

The invention also includes interlocked metal tube formed by any of the aforesaid methods of making interlocked metal tube or constructed and arranged to operate substantially as described herein and as shown in the accompanying drawings.

BRIEF DESCRIPTION OF THE DRAWINGS

The method and interlocked metal tube in accordance with the invention are described, by way of example only, with reference to the accompanying drawings which are of different scales and are in diagrammatic form only, and in which:

FIGS. 1, 2 and 3 are cross-sections of roll-formed metal strip;

FIG. 4 is an elevation of apparatus for forming helical coils of such strip into interlocked metal tube;

FIG. 5 is an elevation of equipment for roll-forming metal strip into sections shown in FIGS. 1, 2 and 3, and into a helical coil for use in the machine shown in FIG. 4, and FIG. 6 is a modification of part of the apparatus shown in FIG. 5 for winding a locking wire around the interlocked metal tube as shown at the right-hand end of FIG. 3.

DESCRIPTION OF THE PREFERRED EMBODIMENTS

FIG. 1 shows a typical enlarged cross-section of the metal strip after it has been passed through the succession of pairs of forming rolls and before it is bent around a mandrel into helical formation. FIG. 2 shows how two adjacent coils of the helix have been inter-engaged and the open ends 2 of the "S" have been closed at 2A to prevent disengagement of adjacent coils. Interlocked metal hose, of the type shown in FIG. 2, can be produced by the known method described hereinbefore or by the method and apparatus according to the present invention.

When intended for use in the apparatus shown in FIG. 4, a roll-formed strip as shown in FIG. 1 is formed into an open-coil helix, in which adjacent coils are not interlocked, by feeding the formed strip through the pinches between an internal roll and two external rolls, adjacent each other and spaced circumferentially around the internal roll. This method of making helices or rings is well known. In this known method, the open coiled helix is rotated during manufacture and, as described hereinbefore, can be made in straight portions only, of limited length, typically 25 meters, depending on diameter. Such lengths are cut and are fed axially, in turn, into the apparatus shown in FIG. 4.

In FIG. 4, a headstock 10 and a tailstock 11 have coaxial tubes 12, 13 rotatable in bearings therein and driven at the same rotational speed or at different speeds by a motor in the headstock 10 through a countershaft 14 and respective belts or chains 15, 16. Where the tube 13 is to be driven at a different speed to the tube 12, the countershaft 14 would be replaced by input and output shaft portions interconnected by a variable speed unit shown diagrammatically at 14A.

The open-coiled helix 17, previously formed, and not now rotating about its axis, enters the tube 13 in the direction of the arrow. The tube 13 is an integral enlargement of a mandrel 18, which is therefore driven by the tube 13. At the junction of the tube 13 and the mandrel 18 there is a helical passageway 19 formed in a downstream end of the tube 13. The passageway 19 forms a tunnel through which open coils of the helix 17 are passed. The portion of the helix 17 at the right-hand end of the passageway 19, as shown in FIG. 2, moves along the outside of the mandrel 18. Thus rotation of the mandrel 18 and hence of the passageway 19 causes the helix 17 to be drawn through the tailstock 11 around the outside of the left-hand or upstream portion of the mandrel 18, as shown in FIG. 4, through the passageway 19 and around the outside of the remainder of the mandrel 18 downstream of the passageway 19 and impelled towards the headstock 10.

The mandrel 18 extends through a face plate 20, fast on the tube 12, so that the mandrel 18 and the face plate 20 rotate at the same or at a required different speed as determined by the variable speed unit 14A. The helix 17 passes through the tube 12, out through a central hole in the face plate 20 and is moved by a plurality of rolls 21 spaced around the face plate 20, in such a way that adjacent coils of the helix 17 are inter-engaged and are then deformed or otherwise locked into position, so that they do not subsequently become disengaged. Thus, an interlocked metal tube 22 is formed and is drawn away from the headstock 10 by power driven belts 23. Since the tube 22 is not rotating it can pass directly on for further processing, or can be wound onto a storage drum, as required.

As the end of the length of a previously formed helix 17 approaches the tailstock 11, the leading end of the next length of helix 17 can be welded to the previous length and the weld can be dressed, since the helix 17 is open-coiled and is readily accessible.

For some thicknesses and materials of metal strip, the power required to deform the section shown in FIG. 1 to the interlocked section shown in FIG. 2 requires an unacceptable amount of power input in the apparatus shown in FIG. 4. In these circumstances an alternative section of roll-formed strip, shown at the left-hand side of FIG. 3, can be used. It will be seen that adjacent coils of the helix 17 can be inter-engaged by radial movement without any deformation, and then pulled axially apart to form the interlocked metal tube. To prevent such a construction becoming disengaged by axial closing of the adjacent coils, protrusions, such as dimples, bumps or bulges 24 as shown in FIG. 3 may be formed at circumferentially spaced intervals, by appropriately shaped one or more of the rollers 21 on the face plate 20. As an alternative to the dimples 24, a springy wire helix 25, as shown in FIG. 3, may be inserted into the groove in the exterior of the metal tube. FIG. 6 shows an alternative or additional face plate 20A provided for this purpose. The face plate 20A which is driven like face-plate 20, in FIG. 4, by the tube 12 in the headstock 10, carries a bobbin 32 of wire, which is guided by rollers 33, also carried on the face plate 20A, in a widely-spaced helix around the interlocked coils of the metal tube in the position shown for the right-hand end coil shown in FIG. 3.

For some purposes, an additional face plate 20 may be mounted on the left-hand end of the tube 12, carrying rollers to perform part of the interlocking operations, which are completed by the rollers 21 on the face plate 20 at the right-hand end of a tube 12.

FIG. 5 shows apparatus for making an open-coiled helix 17 from flat metal strip 26 which is drawn off a free-running drum 27 coaxial with a rotating table 28. This arrangement avoids change in the balance of the table 28 as the contents of the drum 27 are used up. A ramp 29 mounted on the table 28 is inclined at substantially the helix angle of the open-coil helix 17. Pairs of powered forming rollers 30, of which only a few are shown, are mounted with their axes normal to ramp 29 and turn the flat strip 26 into the sections shown in FIGS. 1 or 3. The roll-formed strip is immediately turned into the helix 17 by external rollers 31 and the unshown co-acting internal roller. The helix 27 thus formed passes downwardly through the centre of the rotating table 28 and gradually bends into a horizontal direction, for feeding direct in the direction of the arrow at the left-hand side of FIG. 4 into the tube 13 of the apparatus shown in FIG. 4.

With the apparatus shown in FIG. 5, the helix 17 can be formed continuously until the contents of the spool 27 are used up, and then only a simple straight weld is required before production is resumed. Since the apparatus shown in FIG. 5 must produce the same number of coils of the helix 17 as pass through the passageway 19 in the same time, the table 28 must be rotated at approximately the same number of revolutions per minute as the tube 13 and the mandrel 18.

If preferred, the ramp 29 can be omitted, so that the axes of the rolls 30, 31 are parallel to the axis of rotation of the table 28.

The helical coil 17 formed in a non-rotary manner, for example as shwon in FIG. 5, can be accumulated onto a large drum, rather than cut into individual lengths, and be subsequently fed into the apparatus shown in FIG. 4, thereby reducing the number of welds.

What we claim as our invention and desire to secure by Letters Patent of the United States is:

1. A method of making interlocked metal tube, including the steps of forming a flat strip of the metal into a generally S-shaped cross section;

forming the shaped strip into a helix without interengaging adjacent coils of the helix;

passing the helix thus formed without rotation thereof through a rotatable driving means for moving the non-rotating helix axially of the helix;

interengaging edges of the S-shaped cross section of adjacent coils of the helix by the axial movement, and performing an operation to prevent subsequent disengagement of the adjacent coils, thereby forming an interlocked metal tube.

2. A method according to claim 1, in which the helix rotates as it is formed and then a length of the helix is stopped from rotating and is fed to the said rotatable driving means.

3. A method according to claim 1, including interengaging adjacent coils of the helix and deforming the interengaging coils in a manner which will prevent subsequent disengagement thereof.

4. A method according to claim 3, including elastically bending at least one end of the cross section of the coil during the interengagement process.

5. A method according to claim 3, including forming the strip into a cross section such that the coils are interengaged subsequently without permanent deformation of the coil cross section.

6. A method according to claim 5, including interengaging adjacent coils by a radial movement of one coil relative to the next, and moving the adjacent interengaged coils axially apart.

7. A method according to claim 6, including deforming the coils in a manner to limit axial movement of the adjacent coils towards each other to an amount at which radial disengagement of the coils is not possible.

8. A method according to claim 7, including forming protrusions adjacent the centre of the coil cross-section and circumferentially spaced around the coil.

9. A method according to claim 6, including introducing an elongate element into a groove provided by the cross-section of the interengaged and axially extended coils, the element limiting axial movement of the adjacent coils towards each other to an amount at which radial disengagement of the coils is not possible.

10. A method according to claim 9, in which the element is a helical wire.

11. A method according to claim 9, in which the element is located in the exterior of the interengaged coils.

* * * * *